US005941402A

United States Patent [19]

Krueger

[11] Patent Number: 5,941,402

[45] **Date of Patent: *Aug. 24, 1999**

[54] CHILD-RESISTANT CLOSURE AND CONTAINER APPARATUS

[75] Inventor: Dave Krueger, Lancaster, Pa.

[73] Assignee: Kerr, Lancaster, Pa.

[ * ] Notice: This patent issued on a continued prosecution application filed under 37 CFR 1.53(d), and is subject to the twenty year patent term provisions of 35 U.S.C. 154(a)(2).

[21] Appl. No.: 08/880,454

[22] Filed: Jun. 24, 1998

[51] Int. Cl.[6] ..... B65D 50/08

[52] U.S. Cl. ..... 215/209; 215/218; 215/330

[58] Field of Search ..... 215/209, 216, 215/217, 218, 219, 221, 330, 44, 46

[56] References Cited

U.S. PATENT DOCUMENTS

| | | | |
|---|---|---|---|
| 3,019,931 | 2/1962 | Thornton . | |
| 3,881,625 | 5/1975 | Landen | 215/221 |
| 3,902,620 | 9/1975 | McIntosh . | |
| 3,917,097 | 11/1975 | Uhlig | 215/221 X |
| 4,036,385 | 7/1977 | Morris | 215/221 X |
| 4,144,983 | 3/1979 | Pauls et al. . | |
| 4,204,614 | 5/1980 | Reeve | 215/209 X |
| 4,427,124 | 1/1984 | Marshall et al. . | |
| 4,473,162 | 9/1984 | Donoghue . | |
| 4,948,002 | 8/1990 | Thornock et al. . | |
| 5,413,233 | 5/1995 | Hall . | |
| 5,544,768 | 8/1996 | Gargione | 215/221 X |
| 5,562,218 | 10/1996 | Hamilton et al. . | |
| 5,586,671 | 12/1996 | Thomas et al. . | |
| 5,664,693 | 9/1997 | Krall | 215/221 X |
| 5,727,703 | 3/1998 | Fuchs . | |
| 5,735,417 | 4/1998 | Darr et al. | 215/221 X |

FOREIGN PATENT DOCUMENTS

| | | | |
|---|---|---|---|
| 1456216 | 11/1976 | United Kingdom | 215/209 |

*Primary Examiner*—Stephen K. Cronin
*Assistant Examiner*—Nathan Newhouse
*Attorney, Agent, or Firm*—Kenyon & Kenyon

[57] ABSTRACT

A child resistant closure apparatus is provided that is easily opened by the aged and infirm. The child resistant closure apparatus has a container having a push-tab locking device that locks into place in a series of sawtooth projections on an inner surface of a closure. The closure is rotatably screwed onto the container whereby the push-tab locking device locks into one sawtooth projection. Screwing torque in the direction which would disengage the closure from the container is not possible unless the push-tab locking device is manipulated so that an end of a flexible arm is removed from the sawtooth projection.

8 Claims, 10 Drawing Sheets

CHILD-RESISTANT CLOSURE AND CONTAINER APPARATUS

FIELD OF THE INVENTION

The present invention relates to a child resistant closure and container apparatus for deterring the unauthorized and/or unsupervised opening of a container, and more particularly to a child resistant closure and container apparatus having a closure with a saw-toothed inner surface and a container having a push-tab locking device which locks into place in the saw-toothed inner surface of the closure when the closure is placed on the container.

BACKGROUND INFORMATION

It is a recognized problem that children will often reach for and play with containers which contain medicines or other substances which, if improperly taken, can result in serious and harmful health reactions, and in some instances, even death. As a result many forms of child resistant containers have been designed to prevent children from being able to easily open the containers. This, however, has had the undesirable effect that the aged and infirm have also been unable to open the very same containers to reach and take needed medications, or the like.

U.S. Pat. No. 4,473,162 to Donoghue relates to a child-proof closure assembly having an interlocking lug on a container neck and a plurality of detents on the lower skirt portion of a closure member. Opening of the container is accomplished by pushing in on an exposed portion of the lug to disengage it from the detent in which it rests by a deflection of the container neck. Pushing of the lug causes flexing stress to be placed upon the reduced wall thickness portion of the container neck where the lug is attached, subjecting the container neck to the possibility of breakage.

U.S. Pat. No. 5,562,218 to Hamilton et al. also relates to a two-part child resistant attachment for a container wherein a removable portion of the child resistant attachment is removed to access the contents of the container. In order to remove the removable portion of the child resistant attachment, spring-like pushtabs having vertical extensions on the child resistant attachment are pushed to disengage the vertical extensions from interlocking pawls on an innermost surface of the removable portion of the child resistant attachment. This removable portion is then unscrewed while the pushtabs are still depressed. However, the two-part child resistant attachment in its entirety may be unsnapped or unscrewed either by the screwing torque applied to the removable portion, or by accident.

U.S. Pat. No. 5,586,671 to Thomas et al. relates to a child resistant package having a container with a platform having a deformable pushtab which locks into interlocking pawls on the closure. To remove the closure from the container, the deformable pushtabs are depressed to disengage them from the interlocking pawls, and the closure is rotated. However, the forces involved in deforming the pushtabs creates stress in the platform as well, and, as such, the platform is subject to breakage.

Thus, there remains a need for a child-resistant closure and container apparatus which is difficult for children to open, yet comparatively easy for the aged and infirm to open, and not unduly susceptible to breakage.

SUMMARY OF THE INVENTION

Accordingly, an object of the present invention is to provide a container with a closure which, while presenting a container difficult for children to open, is nevertheless comparatively easy for the aged and infirm to open.

A further objective of the present invention is to provide a closure and container inter-locking device which will not be unduly susceptible to breakage.

To achieve the foregoing and further objectives, and in accordance with the purposes of the present invention, as embodied and broadly described herein, the present invention is directed to a child-resistant closure and container apparatus. Thus a container, for medicines, pills, and the like, according to an embodiment of the present invention, has a neck with an outwardly raised thread encircling the neck for fitting and screwing on of the closure. Furthermore, at a lower portion of the neck, a locking device is attached having a push-tab connected to a lower portion of a flexible arm. A first end of the flexible arm is connected directly with the surface of the neck of the container. As the push-tab connects at a lower portion of the flexible arm, a cut-away area can be provided in the upper body of the container adjacent to where the neck joins the container. This cut-away area accommodates the push-tab and allows for full flexibility of the flexible arm. At the same time, the inner wall of the cut-away area prevents over flexing of the flexible arm thereby preventing breakage. The container may be constructed of plastic or glass.

The closure fits over the container and, likewise, has an inwardly raised thread on an inner surface which complements and meshes with the thread on the neck of the container. By fitting the closure onto the top portion of the neck of the container so that the threads of each mesh complementary, the closure can be rotated and screwed tightly onto the container. Furthermore, a lower end of the inner surface of the closure has a series of sawtooth projections into which an end of the flexible arm of the locking device fits in. In such a manner the end of the flexible arm locks into place as the closure is screwed onto the container such that the closure cannot be rotated in a direction opposite the end of the flexible arm. Thus the closure cannot be opened without first pushing on the tab to release the end of the flexible arm and unlocking the end from the sawtooth projections.

The present invention and its features and advantages will become more apparent from the following detailed description of the preferred embodiments, with reference to the accompanying drawings.

DETAILED DESCRIPTION OF THE PREFERRED EMBODIMENTS

FIGS. 1 to 10 show a child-resistant closure and container apparatus according to the present invention. A closure 100 is mounted on a container 200 through inter-engaging threads 140, 240 so as to prevent unintentional access to the contents of the container 200. The closure 100 is locked into place on the container 200 by a push-tab locking device 300 so that the closure cannot be unscrewed without first manipulating the push-tab locking device 300.

Figure 1:
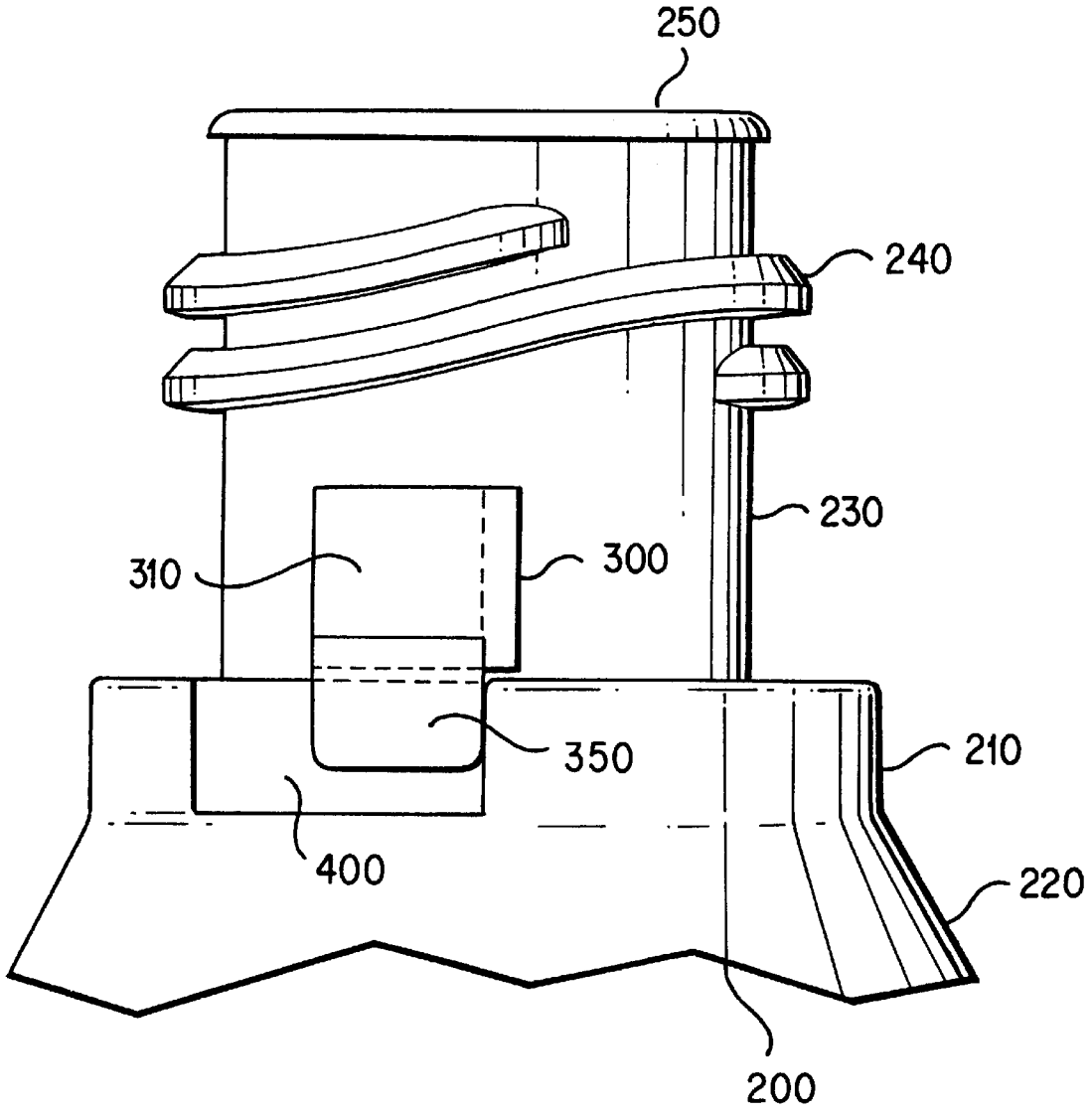
FIG. 1 illustrates a head-on view of the container and the tab lock according to an embodiment of the present invention.

Specifically, FIG. 1 shows a cut-away upper portion of the container 200, including a neck 230 extending upwardly from a container shoulder 210, and a receptacle portion 220. The body of the container shoulder 210 and the receptacle portion 220 may be any suitable shape or size, and preferably are integrally connected to the neck portion 230. Container shoulder 210, receptacle 220 and neck 230 can be manufactured as a unitary structure, and can be manufactured from materials such as plastic or glass, or other suitable materials. The preferred material are plastics such as polyethylene-terephthalate (PET) and polypropylene (PP). The top of neck 230 contains a hollow opening to permit access to the contents of the receptacle 220. The top of neck 230 preferably contains an annular lip 250 which defines the hollow opening. Threads 240 extend from and encircle the neck 230 along its outer circumference. The threads 240 preferably are pitched so as to travel over at least one full turn of the circumference of the neck 230. Thus, the closure 100 may be rotatably screwed onto the container 200 by inter-engagement of the threads 140, 240. In addition, the thread system on the container 200 may include multiple threads of various lengths and sizes, dependent upon the specific embodiment of the present invention.

Figure 2:
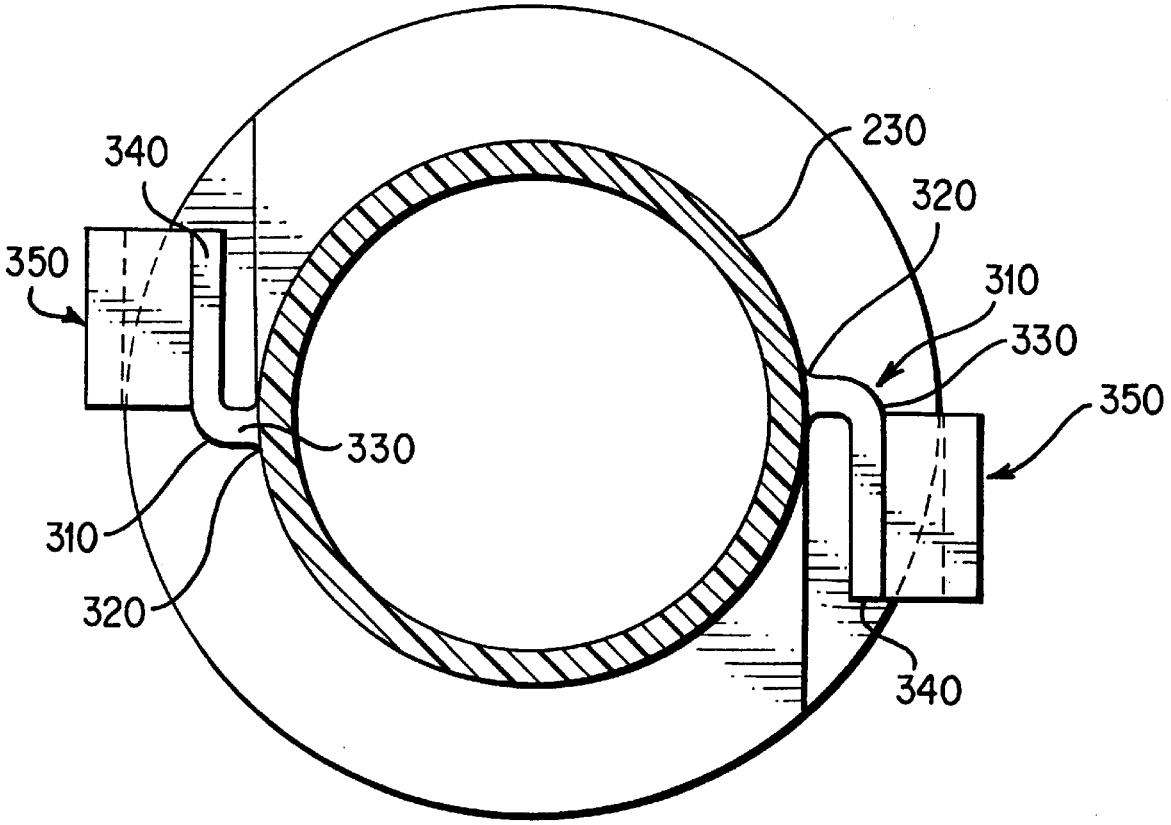
FIG. 2 illustrates a top view of the container and the tab lock according to an embodiment of the present invention.

Referring to FIGS. 1 and 2, a push-tab locking device 300 preferably is attached to a lower portion of the neck 230. The locking device 300 includes a flexible arm 310 and a push-tab 350. The locking device 300 preferably is integrally connected to the outer surface of the neck 230 at a first end 320 of the flexible arm 310, as shown in FIG. 2. The flexible arm 310 preferably is shaped such that a second end 340 of the flexible arm 310 is approximately perpendicular to the first end 320. Thus, a curvature 330 of the flexible arm 310 preferably is such that an angle between the first end 320 and the second end 340 ranges between 75 and 135 degrees, the angle most preferably being 90 degrees. The flexible arm 310 is of such a thickness and length as to allow sufficient flexing while retaining the normal position, such as is depicted in FIG. 2. The thickness of the flexible arm 310 preferably is between 0.02 to 0.07 inches. Most preferably, the thickness of the first end 320 is 0.04 inches, the thickness of the curvature 330 of the flexible arm 310 is 0.03 inches, and the thickness of the second end 340 is 0.04 inches. To allow for proper leverage and ease of manipulation, the length of the second end 340 preferably is between 2 and 6 times the length of the first end 320. Most preferably, the length of the first end 320 is 0.05 inches, the length of the second end 340 is 0.3 inches, and the length of the curvature 330 of the flexible arm 310 is 0.1 inch. The size of the flexible arm, regarding height in a vertical direction, is preferably about 0.3 inches.

Figure 3:
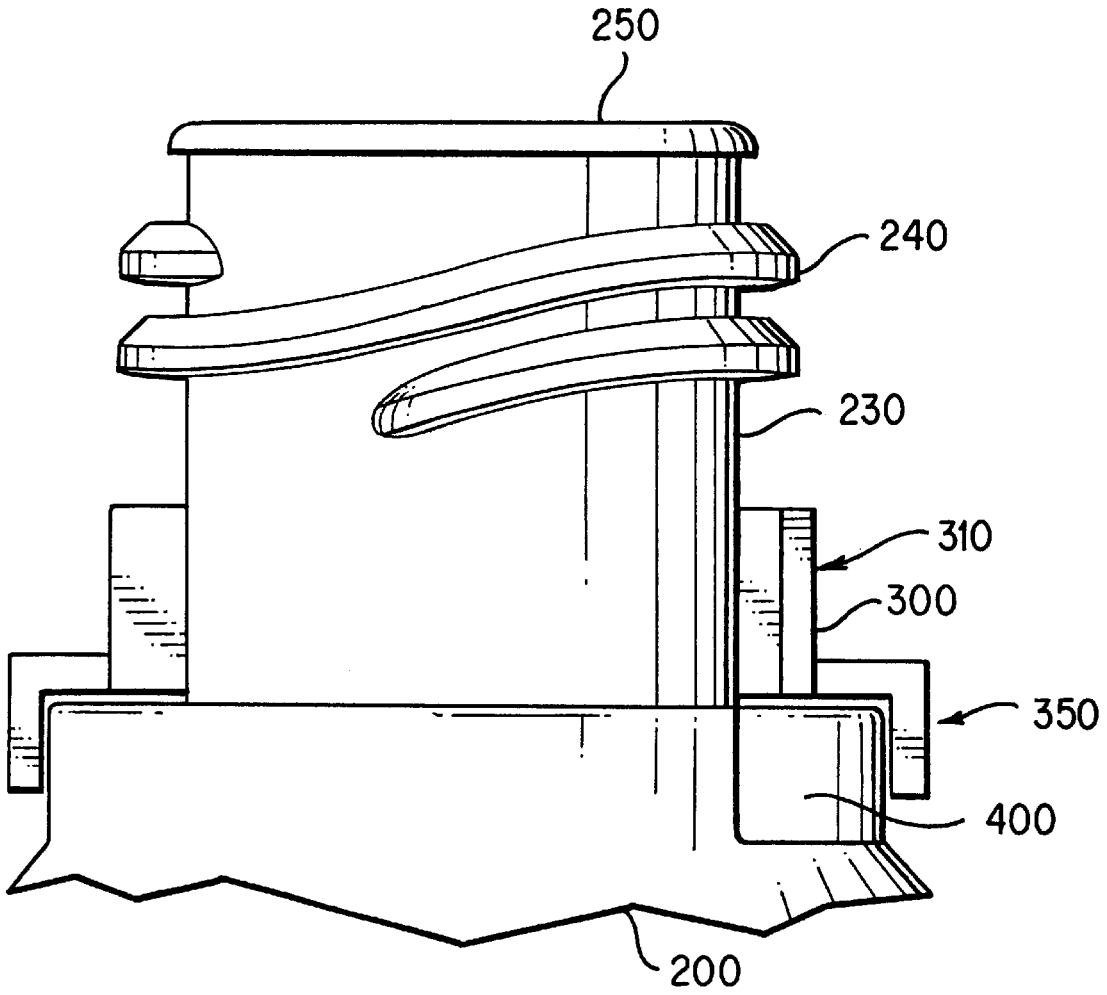
FIG. 3 illustrates a side view of the container and the tab lock according to another embodiment of the present invention.
Figure 4:
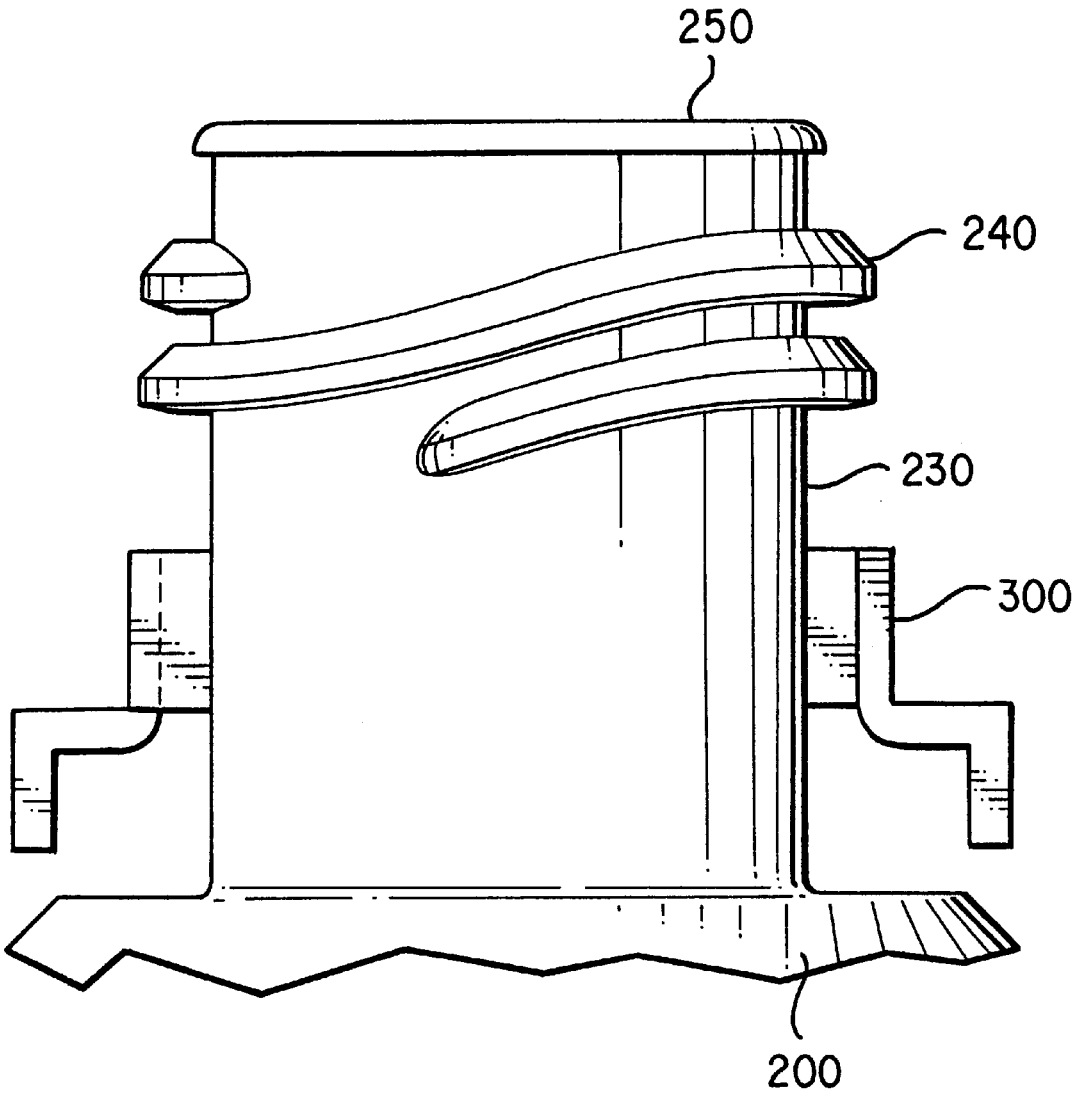
FIG. 4 illustrates a side view of the container and the tab lock according to another embodiment of the present invention.

The push-tab 350 is located on the flexible arm 310 towards the second end 340. Preferably, the push-tab 350 is connected near the bottom, and across the entire length, of the second end 340. The push-tab 350 is preferably integrally connected to the flexible arm 310 and made of the same material as the flexible arm. Alternatively, push-tab 350 may be attached to flexible arm 310 during an assembly of the locking device 300 and/or can be made of a different material. The push-tab 350 preferably extends directionally outward from the flexible arm 310, so as to be positioned beyond the outer circumference of the closure 100. Push-tab 350 preferably also is positioned such that it is below the lower annular skirt 110 of the closure 100 when the closure is screwed fully onto the container. Preferably, the push-tab extends in an L-shape, as shown in FIGS. 3 and 4, to enhance the outward and downward positions of the tab.

Preferably, more than one push-tab locking device 300 is attached to the neck 230, with the most preferable embodiment having two push-tab locking devices 300. If more than one locking device is attached to the neck 230, each of the push-tab locking devices 300 should be manipulated simultaneously in order to allow for removal of the closure 100.

Figure 5:
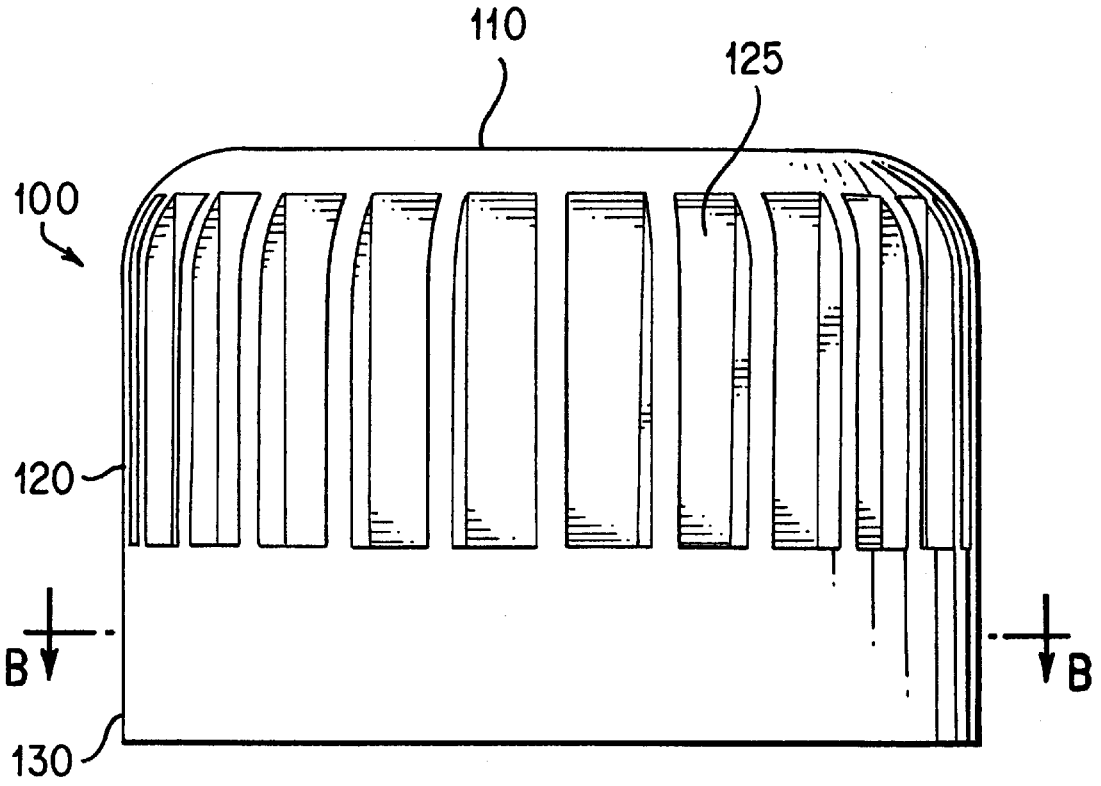
FIG. 5 illustrates a side view of the closure according to an embodiment of the present invention.
Figure 6:
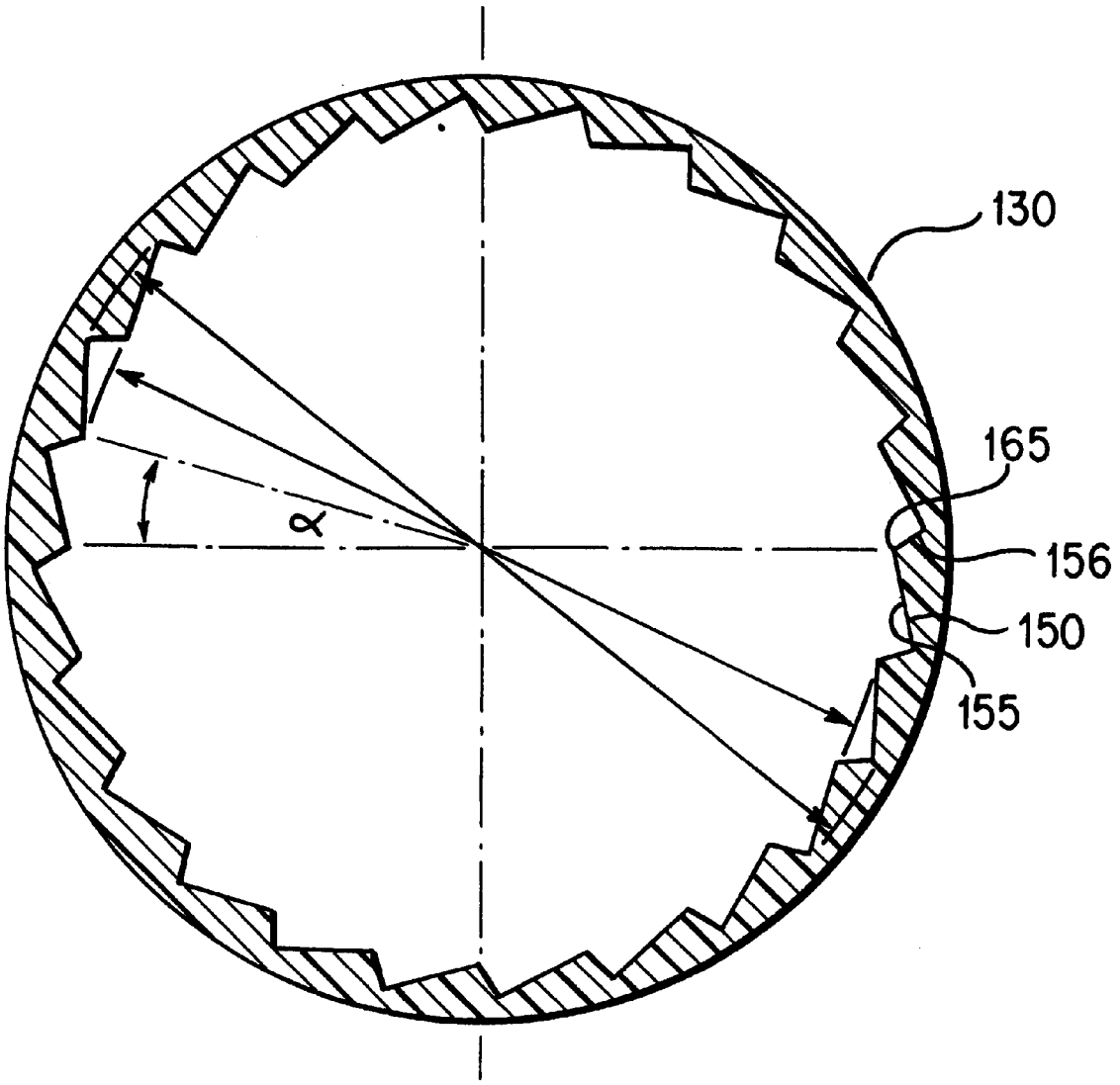
FIG. 6 illustrates a top view of the closure according to an embodiment of the present invention, cut-away along axis B—B of FIG. 5.
Figure 7:
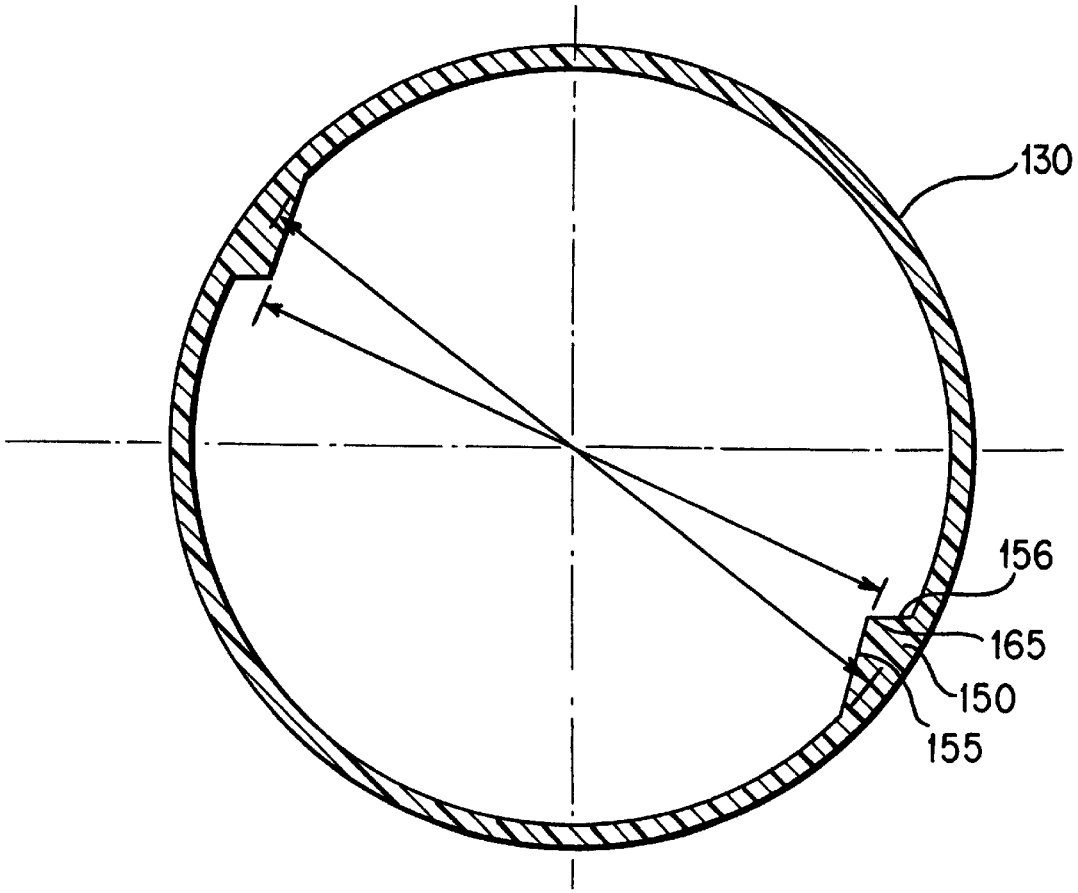
FIG. 7 illustrates a top view of the closure according to another embodiment of the present invention, cut-away along axis B—B of FIG. 5.
Figure 8:
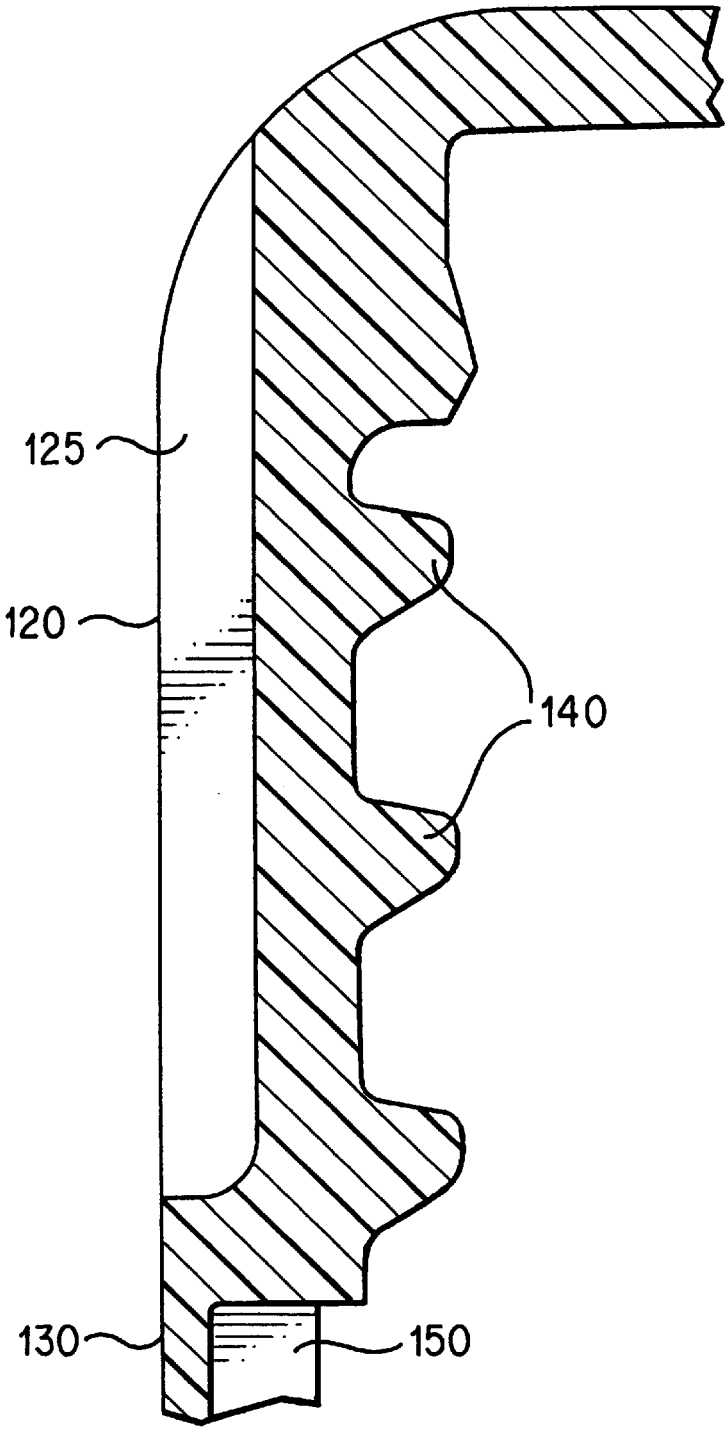
FIG. 8 illustrates a cross-sectional view of the upper inner threaded wall of the closure according to an embodiment of the present invention.
Figure 9:
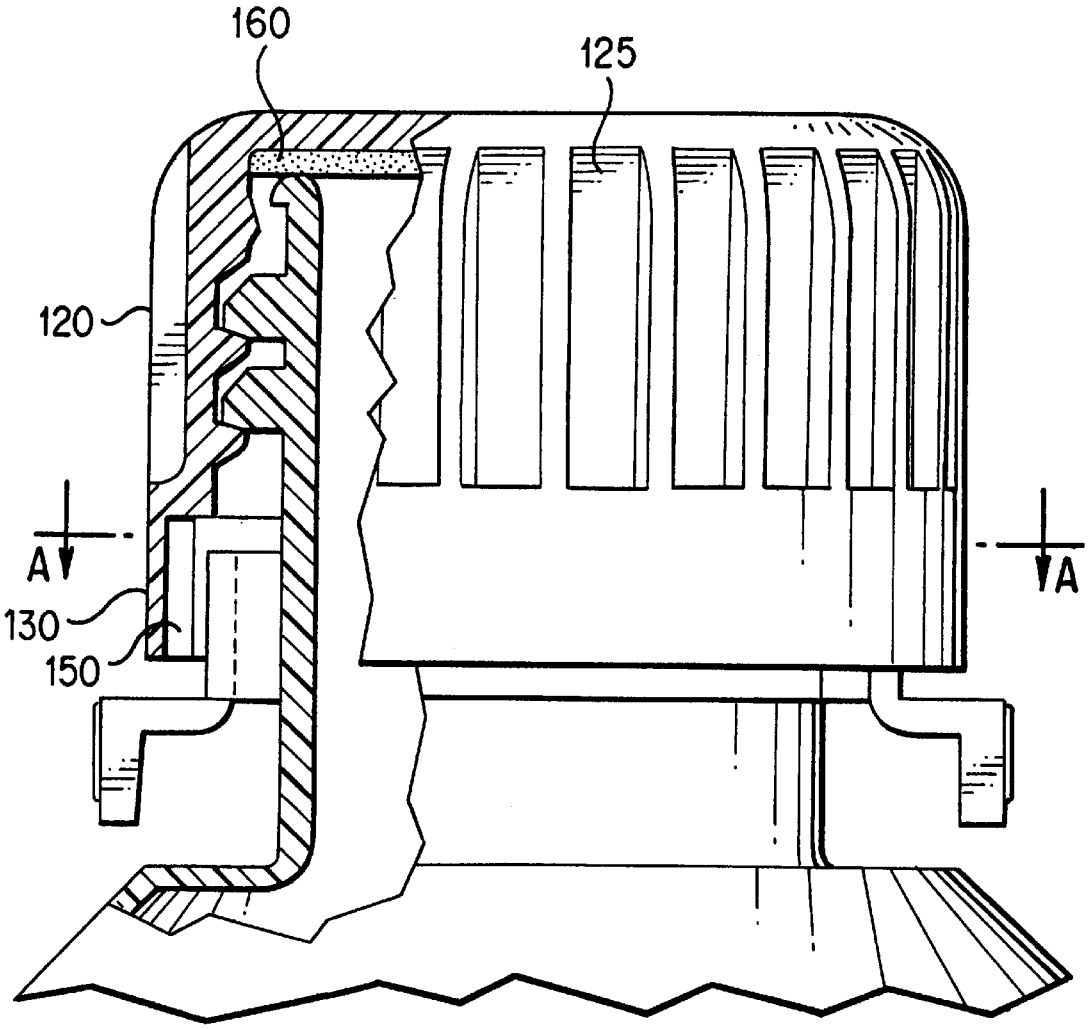
FIG. 9 illustrates a partially cut away side view of a closure and container combination according to an embodiment of the present invention.
Figure 10:
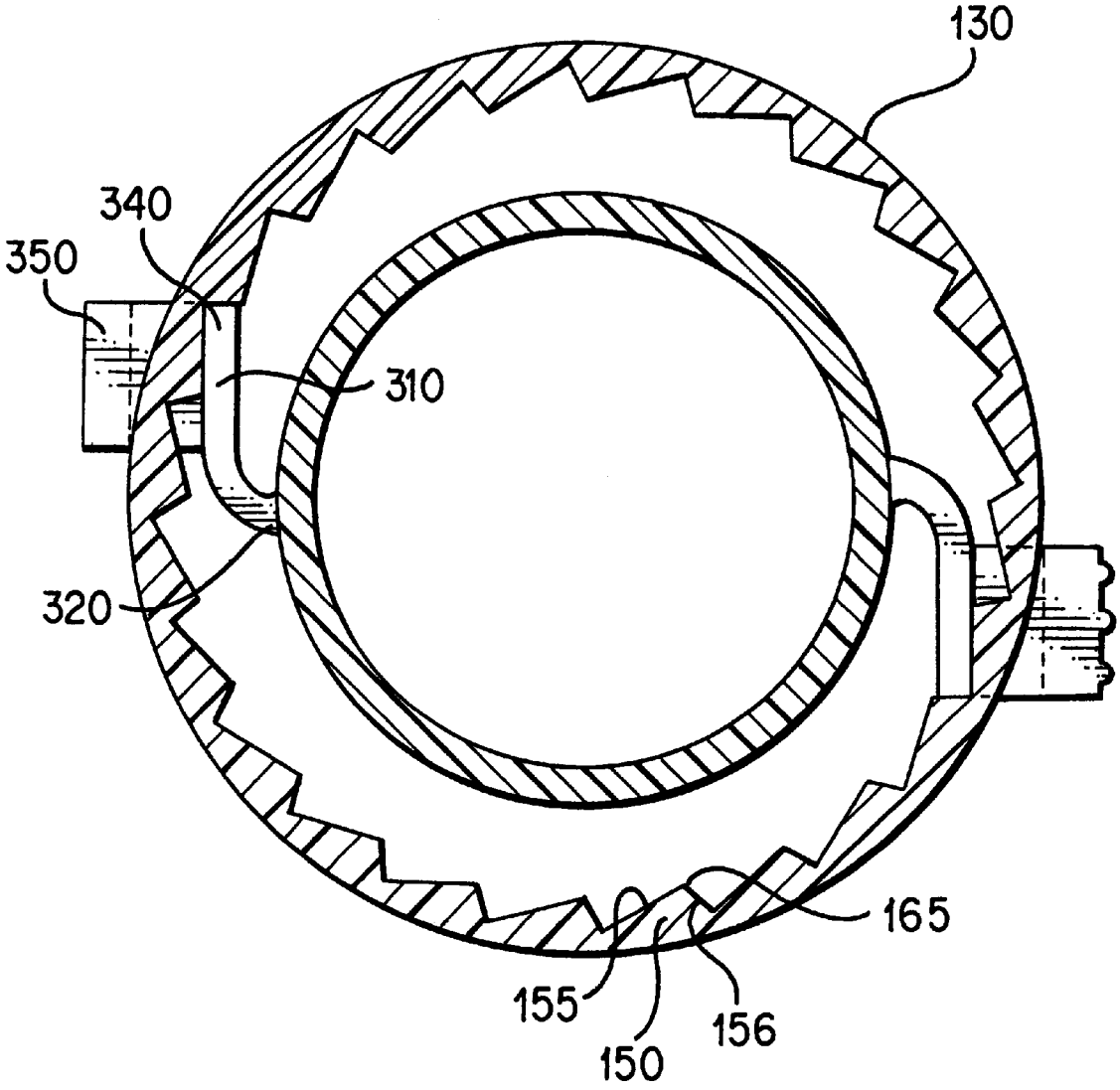
FIG. 10 illustrates a top view of a closure and container combination of the present invention, cut away along axis A—A of FIG. 8.

FIGS. 5, 6 and 7 depict preferred embodiments of the closure according to the present invention. The closure 100 includes a base 110 having an annular skirt 120 depending therefrom and a lower annular skirt 130, which together define an opening into which the neck 230 of the container 200 fits. As shown in FIG. 9, a liner 160 can be placed on an inside surface of the base 110 to help prevent leakage of the contents of the container 200. An outside surface of the annular skirt 120 preferably contains grooves 125, to provide a gripping surface for manipulation. As shown in FIG. 8, an inter-engaging thread 140, complementary to the thread 240 on the neck 230 of the container 200, is positioned on an inner surface of skirt 120. The thread 140 of the closure 100 is designed to engage with the thread 240 of the container 200, as shown in FIG. 8, so as to permit the closure 100 to be rotatably screwed onto the container 200 in one direction and rotatably screwed off the container 200 in an opposite direction.

Referring to FIGS. 5 and 8 to 10, the closure 100 further has a lower annular skirt 130 integrally connected to the annular skirt 120. The inside surface of the lower annular skirt 130 has a series of projections 150, preferably positioned around the inside circumference of the skirt 130. Each projection 150 preferably has two surfaces 155 and 156. An apex 165 of the two surfaces of the projection 150 preferably has a sawtooth construction, at an angle such that when the closure 100 is screwed onto the container 200, the second end 340 of the flexible arm 310 fits into a valley created between two adjacent projections 150, thereby preventing the closure 100 from being unscrewed without manipulation of push-tab 350. Preferably, the angle created from an apex of one projection 150 to an apex of an adjacent projection 150 is fifteen (15) degrees, measuring from a center point of the closure 100, as shown in FIG. 6. Furthermore, preferably the apexes of the projections 150 are such that an inside circumference of the closure 100 from apex to apex is approximately 0.9 inches in diameter, while the inside circumference of the sawtooth projections from valley to valley is approximately 1 inch in diameter. In order to unlock the closure 100 from the container 200, the pushtab 350 is manually depressed causing the flexible arm 310 to flex. This flexion moves the second end 340 of the flexible arm 310 out of and away from the valley between the two sawtooth projections 150 in which it rested. The closure 100 is thus able to be rotated in the direction for opening.

Referring to FIGS. 1, 2 and 3, depending upon the shape and size of the container 200, a cut-away area 400 may be provided in the container shoulder 210 to allow for additional flexing of the flexible arm 310 of the push-tab locking device 300. This cut-away area 400 allows the flexible arm 310 to be flexed enough that the second end 340 is able to be disengaged from the valley between two sawtooth projections 150 in which it is resting, yet not allow so much flexing of the flexible arm 310 that it would be subject to breakage.

It is to be understood and expected that variations in the principles of construction herein disclosed in an embodiment may be made by one skilled in the art and it is intended that such modifications, changes, and substitutions are to be included within the scope of the present invention.

What is claimed is:

1. A child resistant closure and container, comprising:

a container, the container comprising:

a receptacle portion;

a neck, projecting from the receptacle portion, defining an opening accessible to the receptacle portion of the container;

at least one thread engaging the neck along an outer surface circumference; and at least one push-tab locking device having a flexible arm integrally formed in one piece with the neck and having a first portion extending substantially radially outwardly and a second portion extending substantially horizontally and substantially perpendicular to the first portion, and a push-tab integrally attached to the flexible arm adjacent to the second portion; and a closure, the closure comprising:

a base;

an annular skirt, depending from the base and defining an opening into which the neck of the container fits;

at least one thread, on an inner surface of the annular skirt, for complementary engagement with the thread of the neck of the container; and at least one inwardly directed sawtooth projection on the inner surface of the annular skirt below the thread, at least a portion of the sawtooth projection being disposed inwardly of the inner surface of the annular skirt, wherein when the closure is rotatably screwed onto the neck of the container in a closing direction the second portion of the flexible arm fits into one of the sawtooth projections, thereby preventing the closure from being rotatably unscrewed from the neck of the container in an opening direction.

2. The child resistant closure apparatus according to claim 1, wherein the closure can be unscrewed from the container by manually manipulating the push-tab of the push-tab locking device such that the flexible arm flexes enough to remove the second portion from the sawtooth projection in which it rested.

3. The child resistant closure apparatus according to claim 2, wherein the container further comprises:

a container shoulder having a cut-away region allowing the flexible arm of the push-tab locking device to flex enough to move the second portion from the sawtooth projection in which it rested, but not enough so that the flexible arm is subject to breakage.

4. The child resistant closure apparatus according to claim 1, wherein the second portion of the flexible arm is perpendicular to the first end of the flexible arm.

5. The child resistant closure apparatus according to claim 1, wherein the push-tab, integrally connected to the second portion of the flexible arm, extends below and outside of the annular skirt of the closure when the closure is rotatably screwed onto the neck of the container for easy manipulation.

6. The child resistant closure apparatus according to claim 1, wherein an apex of the sawtooth projections of the annular skirt are formed at such an angle that a first and a second surface of the second portion of the flexible arm abut against a first and a second surface of the sawtooth projection.

7. The child resistant closure apparatus according to claim 1, wherein the container and closure are made of plastic.

8. The child resistant closure apparatus according to claim 1, wherein at least one of the receptacle portion and the neck is made of glass and the closure is made of plastic.

* * * * *

UNITED STATES PATENT AND TRADEMARK OFFICE

CERTIFICATE OF CORRECTION

PATENT NO. : 5,941,402

DATED : 24 August 1999

INVENTOR(S) : David F. KRUEGER

It is certified that error appears in the above-indentified patent and that said Letters Patent is hereby corrected as shown below:

In the Title Page:

Change "[22] Filed: Jun. 24, 1998" to –[22] Filed: Jun. 24, 1997–.

Signed and Sealed this

Third Day of April, 2001

*Attest:*

Nicholas P. Godici

NICHOLAS P. GODICI

*Attesting Officer*

*Acting Director of the United States Patent and Trademark Office*